US008878730B2

(12) United States Patent
Hung et al.

(10) Patent No.: US 8,878,730 B2
(45) Date of Patent: Nov. 4, 2014

(54) ANTENNA MODULE AND ELECTRONIC APPARATUS

(75) Inventors: Chen-Ta Hung, Taipei (TW); Wei-Chih Huang, Taipei (TW); Chao-Chu Weng, Taipei (TW); Chieh-Tsao Hwang, Taipei (TW)

(73) Assignee: Compal Electronics, Inc., Taipei (TW)

( * ) Notice: Subject to any disclaimer, the term of this patent is extended or adjusted under 35 U.S.C. 154(b) by 300 days.

(21) Appl. No.: 13/462,833

(22) Filed: May 3, 2012

(65) Prior Publication Data

US 2013/0222190 A1 Aug. 29, 2013

(30) Foreign Application Priority Data

Feb. 24, 2012 (TW) ..... 101106322 A

(51) Int. Cl.
*H01Q 1/38* (2006.01)

(52) U.S. Cl.
USPC ..... 343/700 MS; 343/702; 343/895

(58) Field of Classification Search
None
See application file for complete search history.

(56) References Cited

U.S. PATENT DOCUMENTS

| | | | | |
|---|---|---|---|---|
| 7,511,681 | B2 * | 3/2009 | Bolin | 343/876 |
| 7,969,364 | B2 * | 6/2011 | Kriebel et al. | 343/702 |
| 8,367,035 | B2 * | 2/2013 | Rogers et al. | 423/447.3 |
| 2009/0284440 | A1 * | 11/2009 | Weidmann et al. | 343/893 |
| 2011/0012794 | A1 * | 1/2011 | Schlub et al. | 343/702 |

* cited by examiner

*Primary Examiner* — Trinh Dinh
(74) *Attorney, Agent, or Firm* — Jianq Chyun IP Office

(57) ABSTRACT

An antenna module and an electronic apparatus are provided. The electronic apparatus includes a housing and the antenna module. The housing has an inner surface. The antenna module includes a circuit board, a proximity sensor and a sensing antenna patch. The circuit board is disposed in the housing, and has a top surface and a bottom surface opposite to the top surface. The circuit board has a communication antenna pattern on the top surface. The proximity sensor is mounted on the bottom surface. The sensing antenna patch is assembled on the inner surface of the housing and electrically connected to the proximity sensor. An orthogonal projection of the communication antenna pattern on the inner surface overlaps the sensing antenna patch on the inner surface.

13 Claims, 5 Drawing Sheets

ANTENNA MODULE AND ELECTRONIC APPARATUS

CROSS-REFERENCE TO RELATED APPLICATION

This application claims the priority benefit of Taiwan application serial no. 101106322, filed on Feb. 24, 2012. The entirety of the above-mentioned patent application is hereby incorporated by reference herein and made a part of this specification.

BACKGROUND OF THE INVENTION

1. Field of the Invention

The invention relates to an electronic module and an electronic apparatus. Particularly, the invention relates to an antenna module and an electronic apparatus using the same.

2. Description of Related Art

Generally speaking, electromagnetic waves radiated by an antenna may often be harmful to human health, so that the Federal Communications Commission (FCC) specifies a specific absorption ratio (SAR) for electronic apparatus, so as to limit radiation energy of the electronic apparatus or a maximum radiation limit of the electronic apparatus.

Besides, in order to ensure communication quality of the electronic apparatus, an over the air (OTA) test is a set of standards used to evaluate the whole communication quality of the electronic apparatus. In such set of standards, a total radiated power (TRP) is a major measurement parameter in the OTA test, which is used to measure radiation performance of a transmitter of the electronic apparatus.

In order to make the SAR value to comply with a test specification, in the conventional electronic apparatus, sensing antennas are configured to both ends of a communication antenna, and sensors are used in collaboration with the sensing antennas to detect a distance between the electronic apparatus and human body, so as to determine whether or not to decrease a radiation power of the communication antenna, and maintain the SAR value within a safe test range.

However, the sensors can only perform object detection at the two ends of the communication antenna, so that a sensing range of the sensors is relatively small, and even a central part of the antenna cannot perform the detection. Therefore, how to satisfy the safety requirement specified by the SAR value and consider communication quality of the electronic apparatus simultaneously has become a major problem.

SUMMARY OF THE INVENTION

The invention is directed to an antenna module, which has a relatively large sensing range and a better radiation performance.

The invention provides an electronic apparatus having the aforementioned antenna module to achieve better radiation performance, which avails maintaining communication quality.

The invention provides an antenna module, which is adapted to an electronic apparatus. The electronic apparatus has a housing, and the housing has an inner surface. The antenna module includes a circuit board, a proximity sensor and a sensing antenna patch. The circuit board is disposed in the housing, and has a top surface and a bottom surface opposite to the top surface. The circuit board has a communication antenna pattern on the top surface. The proximity sensor is mounted on the bottom surface. The sensing antenna patch is assembled on the inner surface of the housing and electrically connected to the proximity sensor. An orthogonal projection of the communication antenna pattern on the inner surface overlaps the sensing antenna patch.

The invention provides an electronic apparatus including a housing and an antenna module. The housing has an inner surface. The antenna module includes a circuit board, a proximity sensor and a sensing antenna patch. The circuit board is disposed in the housing, and has a top surface and a bottom surface opposite to the top surface. The circuit board has a communication antenna pattern on the top surface. The proximity sensor is mounted on the bottom surface. The sensing antenna patch is assembled on the inner surface of the housing and electrically connected to the proximity sensor. An orthogonal projection of the communication antenna pattern on the inner surface overlaps the sensing antenna patch.

According to the above description, the top surface and the bottom surface of the circuit board respectively of the invention have the communication antenna pattern and the proximity sensor, and the proximity sensor is electrically connected to the sensing antenna patch, and the orthogonal projection of the communication antenna pattern overlaps the sensing antenna patch. In this way, a sensing range of the proximity sensor is enlarged to satisfy a safety requirement, and meanwhile the electronic apparatus using the antenna module may maintain the requirements in safety and communication quality.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
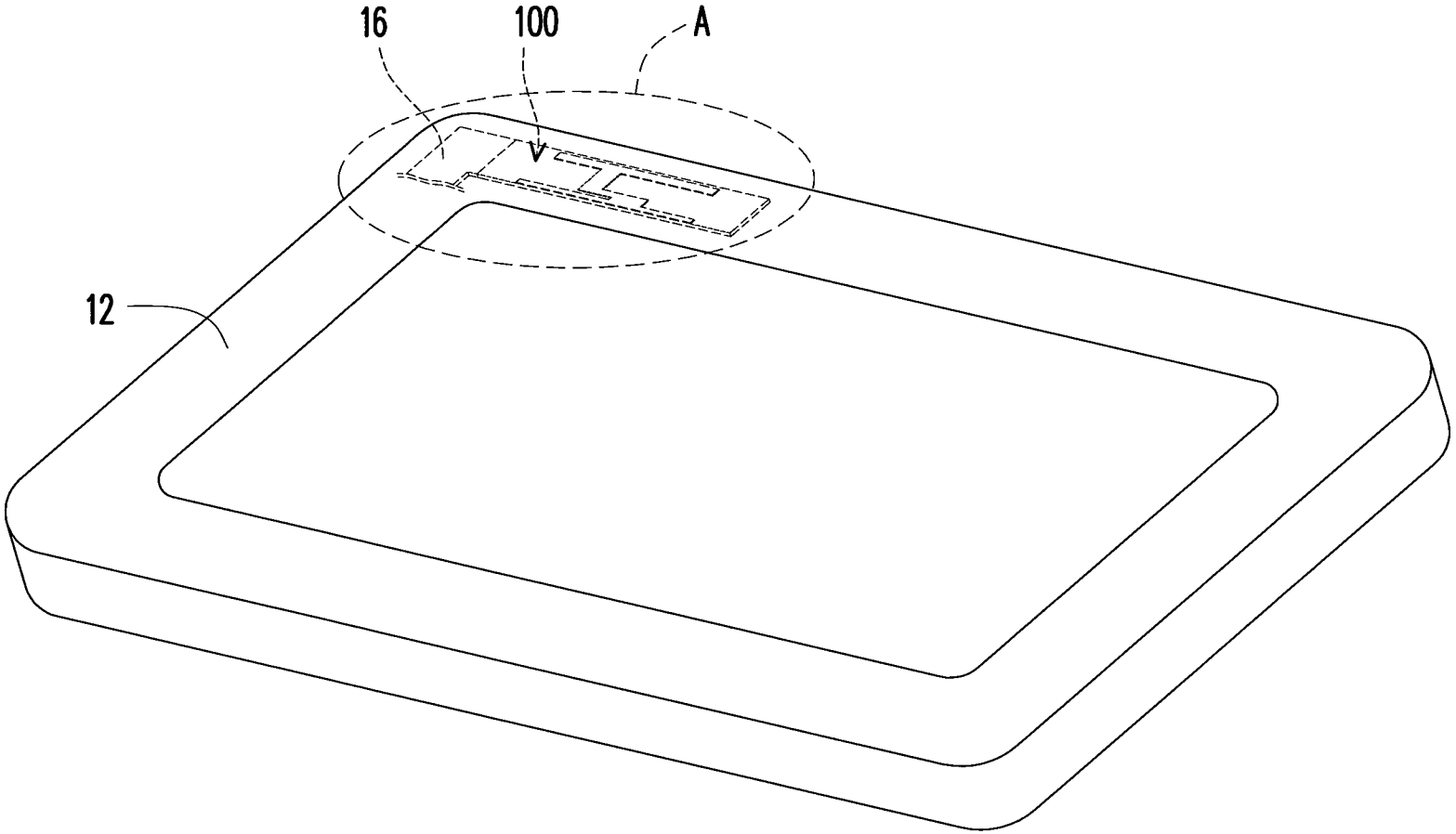
FIG. 1 is a perspective view of an electronic apparatus according to an embodiment of the invention.
Figure 2:
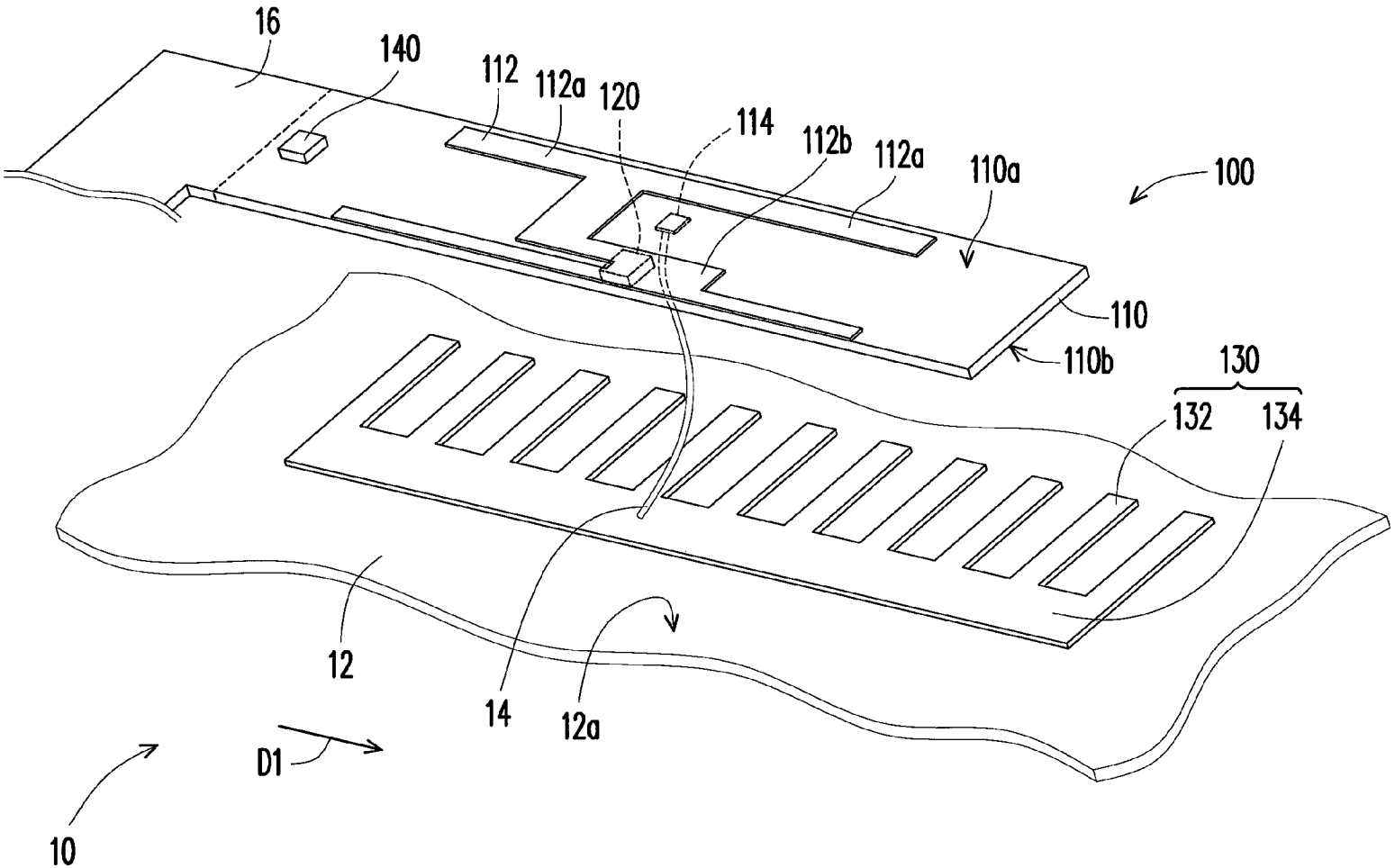
FIG. 2 is an exploded view of an antenna module of FIG. 1 at a part A.
Figure 3:
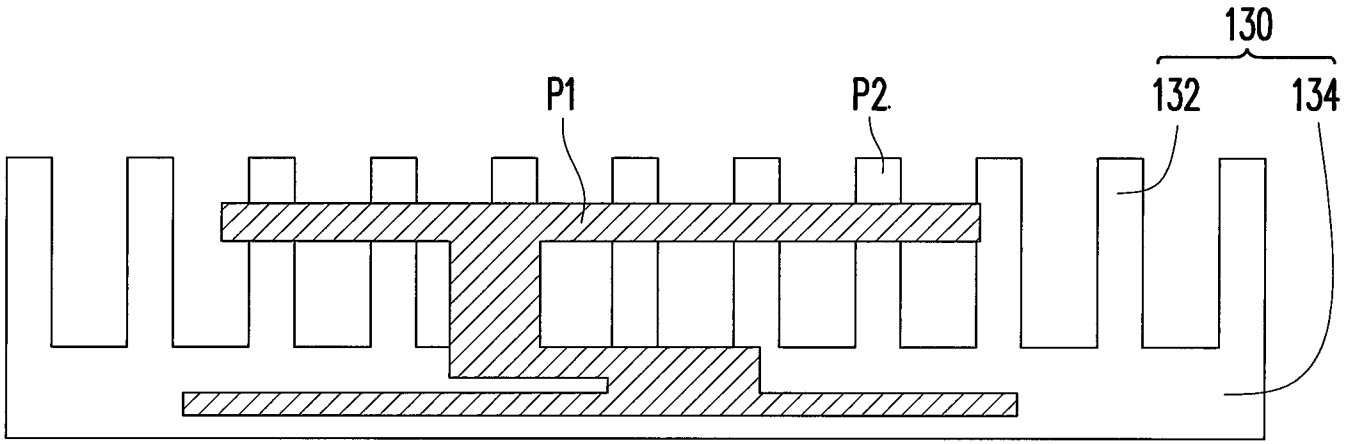
FIG. 3 illustrates orthogonal projections of a communication antenna pattern and a sensing antenna patch of FIG. 2 on an inner surface of a housing.

FIG. 1 is a perspective view of an electronic apparatus according to an embodiment of the invention. FIG. 2 is an exploded view of an antenna module of FIG. 1 at a part A. FIG. 3 illustrates orthogonal projections of a communication antenna pattern and a sensing antenna patch of FIG. 2 on an inner surface of a housing. Referring to FIG. 1, FIG. 2 and FIG. 3, in the present embodiment, the electronic apparatus 10 includes a housing 12 and an antenna module 100, wherein the electronic apparatus 10 is, for example, a handheld electronic device such as a tablet computer or a smart phone, etc.

The antenna module 100 includes a circuit board 110, a proximity sensor 120 and a sensing antenna patch 130. The circuit board 110 is disposed in the housing 12, and has a top surface 110*a* and a bottom surface 110*b* opposite to the top surface 110*a*. The circuit board 110 has a communication antenna pattern 112 on the top surface 110*a* for receiving and transmitting wireless signals. The communication antenna pattern 112 has a radiation portion 112*a* and a ground portion 112*b*. The proximity sensor 120 is mounted on the bottom surface 110*b* of the circuit board 110.

The sensing antenna patch 130 is assembled on the inner surface 12*a* of the housing 12 and electrically connected to the proximity sensor 120, wherein an orthogonal projection P1 of the communication antenna pattern 112 on the inner surface 12*a* of the housing 12 overlaps the orthogonal projection P2 of the sensing antenna patch 130.

In the present embodiment, the electrical connection between the sensing antenna patch 130 and the proximity sensor 120 can be implemented through one or a plurality of conductors 14, for example, a cable or a conductive spring leaf is used to electrically connect the sensing antenna patch 130 and the proximity sensor 120.

After the power of the electronic apparatus 10 is turned on, the proximity sensor 120 senses the environment through the sensing antenna patch 130, so as to detect whether an object (for example, user's cheek or finger) approaches the communication antenna pattern 112.

Since the sensing antenna patch 130 overlaps the orthogonal projection P1 of the communication antenna pattern 112, regardless how the object approaches the communication antenna pattern 112, the sensing antenna patch 130 can sense approach of the object, and send a signal to a system of the electronic apparatus 10 through the proximity sensor 120 to decrease radiation power of the communication antenna pattern 112. In this way, a sensing range of the proximity sensor 120 is enlarged to satisfy a safety requirement.

In the present embedment, the sensing antenna patch 130 may include a plurality of sensing portions 132 and a connection portion 134. The sensing portions 132 are connected to the connection portion 134, and the sensing portions 132 are arranged along a length direction D1 of the circuit board 110 and equally spaced from each other, wherein the sensing portions 132 and the connection portion 134 present a comb shape. Since the communication antenna pattern 112 is not completely covered by the sensing antenna patch 130, and the connection portion 134 of the sensing antenna patch 130 mainly covers the ground portion 112*b* of the communication antenna pattern 112, and the communication antenna pattern 112 mainly radiates through the radiation proton 112*a*, the communication antenna pattern 112 may have better radiation performance to ensure good communication quality of the electronic apparatus 10.

Moreover, the circuit board 110 has a contact 114, which is disposed on the bottom surface 110*b* of the circuit boar 110, and the contact 114 is, for example, a pad. The contact 114 is electrically connected to the sensing antenna patch 130 and the proximity sensor 120. In the present embodiment, the contact 114 and the proximity sensor 120 can be electrically connected to each other through a circuit pattern of the circuit board 110, and the contact 114 and the sensing antenna patch 130 can be electrically connected to each other through the conductor 14, so that the sensing antenna patch 130 and the proximity sensor 120 are electrically connected.

In the present embodiment, the antenna module 100 may further include a connection port 140, which is disposed on the circuit board 110 and electrically connected to the proximity sensor 120. Similarly, the connection port 140 and the proximity sensor 120 can be electrically connected to each other through a circuit pattern of the circuit board 110. In this way, the connection port 140 can serve as a connection interface between the system of the electronic apparatus 10 and the proximity sensor 120.

In the present embodiment, the electronic apparatus 10 may further include a motherboard 16, which is disposed in the housing 12, and the circuit board 110 can be a part of the motherboard 16. In other words, the circuit board 110 of the present embodiment can be formed by an extending portion of the motherboard 16. In this way, the motherboard 16 and the circuit board 110 are combined to reduce the number of components of the electronic apparatus 10, so as to reduce a manufacturing cost of the electronic apparatus 10. It should be noticed that for simplicity's sake, only a part of the motherboard 16 is illustrated in FIG. 1 and FIG. 2.

Figure 4:
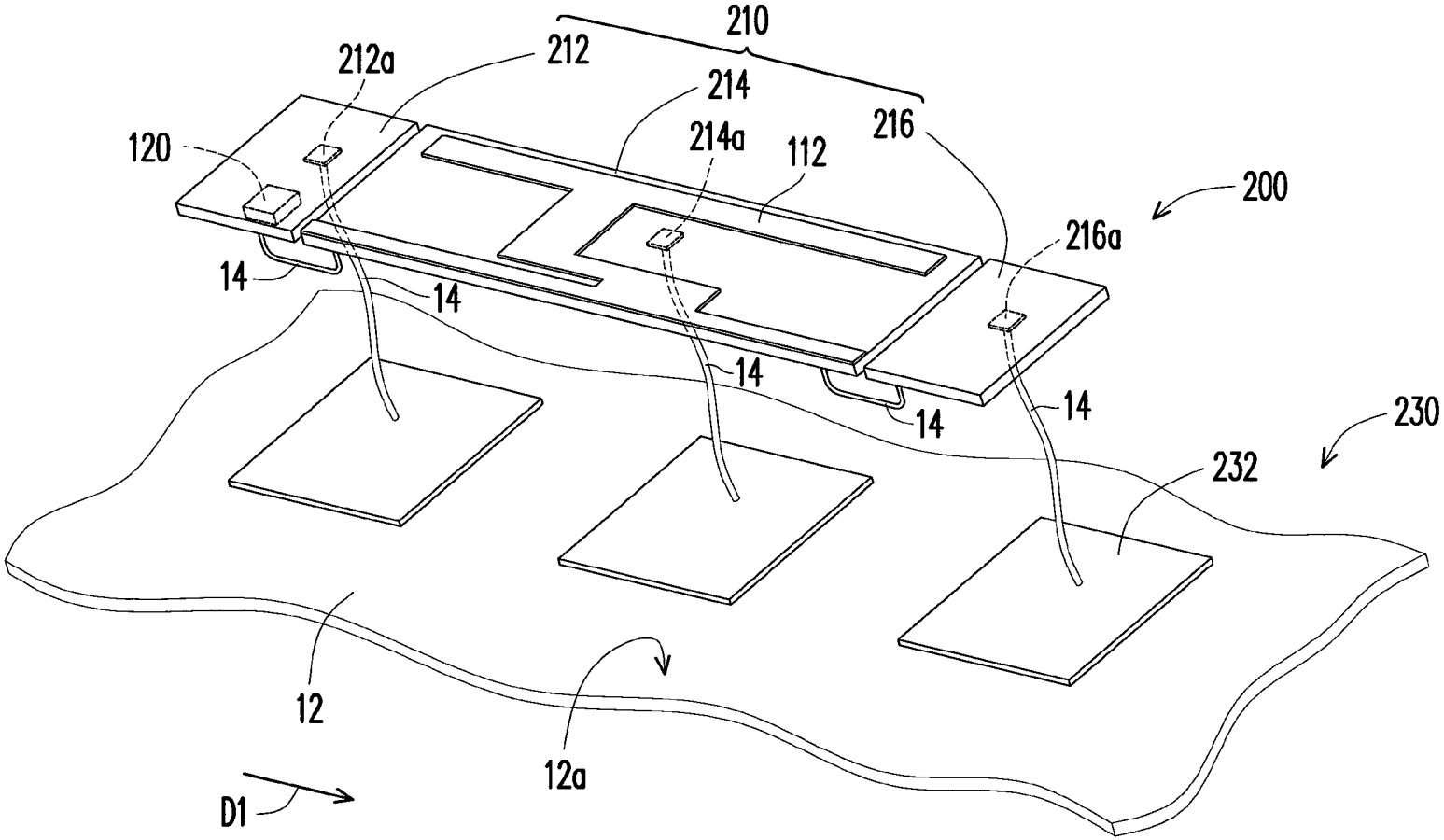
FIG. 4 is an exploded view of an antenna module according to another embodiment of the invention.
Figure 5:
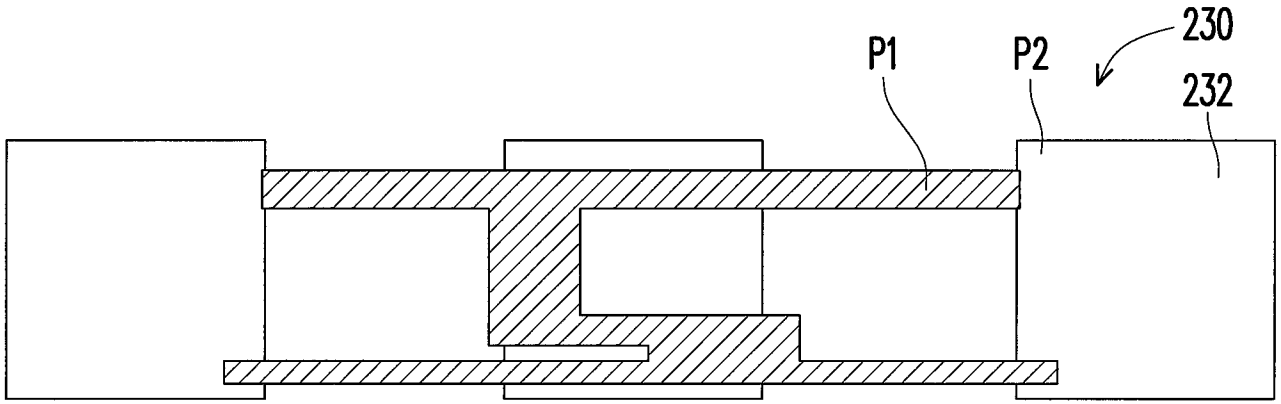
FIG. 5 illustrates orthogonal projections of a communication antenna pattern and a sensing antenna patch of FIG. 4 on an inner surface of a housing.

FIG. 4 is an exploded view of an antenna module according to another embodiment of the invention. FIG. 5 illustrates orthogonal projections of a communication antenna pattern and a sensing antenna patch of FIG. 4 on an inner surface of a housing. Referring to FIG. 4 and FIG. 5, in the present embodiment, the antenna module 200 is similar to the antenna module 100 of FIG. 2, and only differences there between are introduced. A sensing antenna patch 230 of the present embodiment includes a plurality of sensing portions 232, and a circuit board 210 includes a plurality of sub circuit boards 212, 214 and 216. The sensing portions 232 are arranged along the length direction D1 of the circuit board 210 and equally spaced from each other. Moreover, the sensing portions 232 are electrically connected to the sub circuit boards 212, 214 and 216, respectively. The sub circuit board 214 has the communication antenna pattern 112, and the proximity sensor 120 is disposed on a bottom surface of the sub circuit board 212.

Moreover, the sub circuit boards 212, 214 and 216 respectively have contacts 212*a*, 214*a* and 216*a*. The contacts 212*a*, 214*a* and 216*a* are respectively disposed on bottom surfaces of the sub circuit boards 212, 214 and 216 and electrically connected to the sensing portions 232, and the contacts 212*a*, 214*a* and 216*a* respectively connect the sensing portions 232 with the proximity sensor 120.

Further, the contacts 214*a* and 216*a* and the proximity sensor 120 can be electrically connected through the conductors 14 (for example, cables), the contacts 212*a* and the proximity sensor 120 can be electrically connected to each other through a circuit pattern of the sub circuit board 212, and the contacts 212*a*, 214*a* and 216*a* and the corresponding sensing portions 232 can be electrically connected through the conductors 14. Moreover, the orthogonal projection P1 of the communication antenna pattern 112 on the inner surface 12*a* of the housing 12 still overlaps the orthogonal projection P2 of the sensing antenna patch 230.

In summary, the top surface and the bottom surface of the circuit board of the invention respectively have the communication antenna pattern and the proximity sensor, and the proximity sensor is electrically connected to the sensing antenna patch, and the orthogonal projection of the communication antenna pattern overlaps the sensing antenna patch. In this way, a sensing range of the proximity sensor is enlarged to satisfy a safety requirement, and the electronic apparatus may maintain the requirement in safety.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An antenna module, adapted to an electronic apparatus, the electronic apparatus having a housing, and the housing having an inner surface, and the antenna module comprising:

a circuit board, disposed in the housing, and having a top surface and a bottom surface opposite to the top surface, wherein the circuit board has a communication antenna pattern on the top surface and comprises a plurality of sub circuit boards;

a proximity sensor, mounted on the bottom surface; and a sensing antenna patch, assembled on the inner surface of the housing and electrically connected to the proximity sensor, wherein an orthogonal projection of the communication antenna pattern on the inner surface overlaps the sensing antenna patch, the sensing antenna patch comprises a plurality of sensing portions arranged along a length direction of the circuit board and equally spaced from each other, and the sensing portions are respectively connected to the sub circuit boards, wherein one of the sub circuit boards has the communication antenna pattern, and the proximity sensor is disposed on another one of the sub circuit boards.

2. The antenna module as claimed in claim 1, wherein the sensing antenna patch comprises a plurality of sensing portions and a connection portion, the sensing portions are connected to the connection portion, and the sensing portions are arranged along a length direction of the circuit board and equally spaced from each other.

3. The antenna module as claimed in claim 2, wherein the sensing portions and the connection portion present a comb shape.

4. The antenna module as claimed in claim 1, wherein each of the sub circuit boards has a contact, each of the contacts is disposed on the bottom surface of the corresponding sub circuit board and electrically connected to the corresponding sensing portion, and each of the contacts electrically connects the corresponding sensing portion and the proximity sensor.

5. The antenna module as claimed in claim 1, wherein the circuit board has a contact, the contact is disposed on the bottom surface of the circuit board, and the contact electrically connects the sensing antenna patch and the proximity sensor.

6. The antenna module as claimed in claim 1, further comprising:

a connection port, disposed on the circuit board and electrically connected to the proximity sensor.

7. An electronic apparatus, comprising:

a housing, having an inner surface;

an antenna module, comprising:

a circuit board, disposed in the housing, and having a top surface and a bottom surface opposite to the top surface, wherein the circuit board has a communication antenna pattern on the top surface and comprises a plurality of sub circuit boards;

a proximity sensor, mounted on the bottom surface; and a sensing antenna patch, assembled on the inner surface of the housing and electrically connected to the proximity sensor, wherein an orthogonal projection of the communication antenna pattern on the inner surface overlaps the sensing antenna patch, the sensing antenna patch comprises a plurality of sensing portions arranged along a length direction of the circuit board and equally spaced from each other, and the sensing portions are respectively connected to the sub circuit boards, wherein one of the sub circuit boards has the communication antenna pattern, and the proximity sensor is disposed on another one of the sub circuit boards.

8. The electronic apparatus as claimed in claim 7, wherein the sensing antenna patch comprises a plurality of sensing portions and a connection portion, the sensing portions are connected to the connection portion, and the sensing portions are arranged along a length direction of the circuit board and equally spaced from each other.

9. The electronic apparatus as claimed in claim 8, wherein the sensing portions and the connection portion present a comb shape.

10. The electronic apparatus as claimed in claim 7, wherein each of the sub circuit boards has a contact, each of the contacts is disposed on the bottom surface of the corresponding sub circuit board and electrically connected to the corresponding sensing portion, and each of the contacts electrically connects the corresponding sensing portion and the proximity sensor.

11. The electronic apparatus as claimed in claim 7, wherein the circuit board has a contact, the contact is disposed on the bottom surface of the circuit board, and the contact electrically connects the sensing antenna patch and the proximity sensor.

12. The antenna module as claimed in claim 7, wherein the antenna module further comprises a connection port disposed on the circuit board and electrically connected to the proximity sensor.

13. The antenna module as claimed in claim 7, further comprising a motherboard disposed in the housing, wherein the circuit board forms a part of the motherboard.

* * * * *